US008621899B2

(12) United States Patent
Kuo et al.

(10) Patent No.: US 8,621,899 B2
(45) **Date of Patent: *Jan. 7, 2014**

(54) TAMPER INDICATING PADLOCK

(71) Applicant: Sinox Company Ltd., Taipei County (TW)

(72) Inventors: Yung-Li Kuo, Taipei County (TW); Renny T. Ling, Taipei County (TW)

(73) Assignee: Sinox Company Ltd., Chung-Ho (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/673,627

(22) Filed: Nov. 9, 2012

(65) Prior Publication Data

US 2013/0111958 A1 May 9, 2013

Related U.S. Application Data

(63) Continuation of application No. 11/420,687, filed on May 26, 2006, now Pat. No. 8,353,184.

(60) Provisional application No. 60/685,212, filed on May 27, 2005.

(51) Int. Cl.
*E05B 37/02* (2006.01)

(52) U.S. Cl.
USPC ..... 70/21; 70/284; 70/285; 70/330; 70/432

(58) Field of Classification Search
USPC ..... 70/20–22, 31, 284, 285, 330–332, 432, 70/435, 437, 439, 441
See application file for complete search history.

(56) References Cited

U.S. PATENT DOCUMENTS

| | | | | |
|---|---|---|---|---|
| 6,047,577 | A * | 4/2000 | Klimas | 70/340 |
| 6,877,345 | B1 * | 4/2005 | Misner et al. | 70/25 |
| 7,140,209 | B2 * | 11/2006 | Lai | 70/21 |
| 7,210,318 | B2 * | 5/2007 | Yu | 70/21 |
| 7,216,517 | B2 * | 5/2007 | Ling et al. | 70/21 |
| 7,357,007 | B2 * | 4/2008 | Lin | 70/21 |
| 7,628,045 | B2 * | 12/2009 | Yu | 70/21 |
| 8,171,760 | B2 * | 5/2012 | Yen et al. | 70/21 |
| 8,353,184 | B2 * | 1/2013 | Ling et al. | 70/21 |
| 2006/0150690 | A1 * | 7/2006 | Lai et al. | 70/21 |
| 2007/0227202 | A1 * | 10/2007 | Yen et al. | 70/21 |
| 2008/0011026 | A1 * | 1/2008 | Huang | 70/21 |

* cited by examiner

*Primary Examiner* — Christopher Boswell
(74) *Attorney, Agent, or Firm* — Sheridan Ross P.C.

(57) ABSTRACT

A travel padlock for securing an article comprises a housing having a shackle, a key lock and a combination lock. An indicator having at least first and second positions is moved from the first position to the second position upon insertion of an object longitudinally into a key hole of the key lock. In at least one embodiment, at least a portion of the indicator extends beyond the exterior of the housing when in the second position. In addition, in at least one embodiment of the present invention the shackle may be rotated to reset the indicator from the second position back to the first position. Furthermore, in at least one embodiment of the present invention the indicator may be reset from the second position back to the first position without rotating the shackle or unlocking the combination lock. Methods of making and using the padlock are also provided.

25 Claims, 9 Drawing Sheets

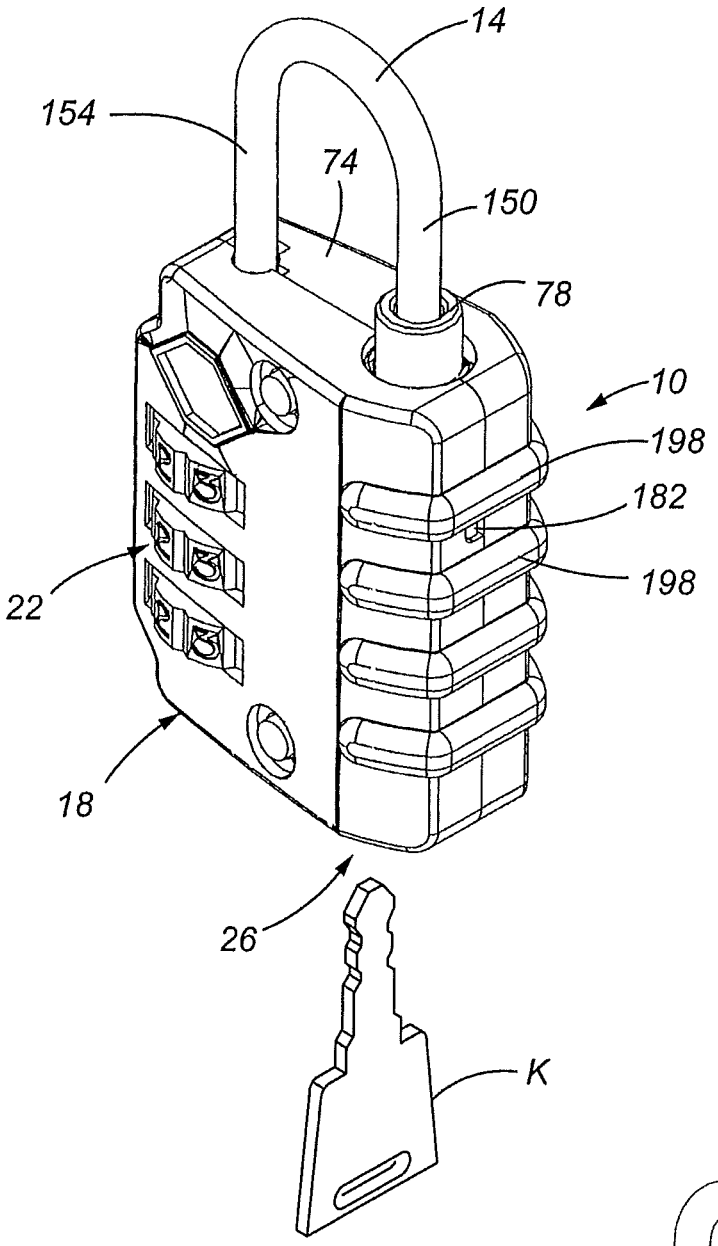
Fig. 1
Fig. 1A
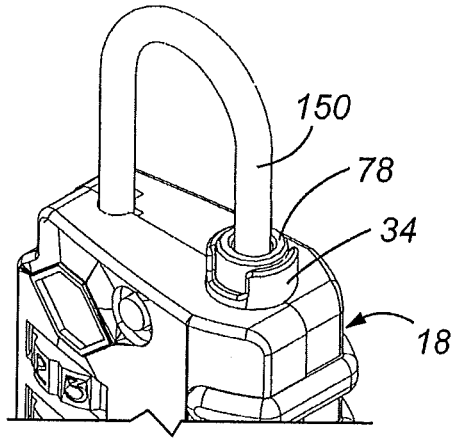

Fig. 5
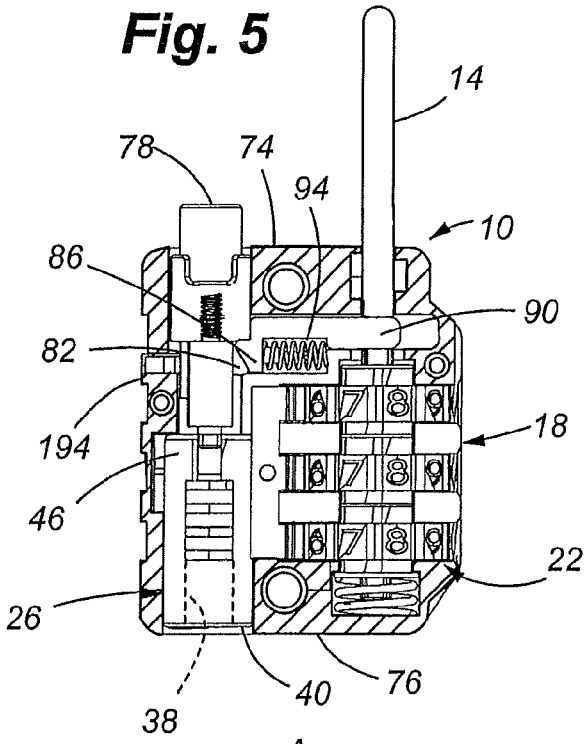
Fig. 6
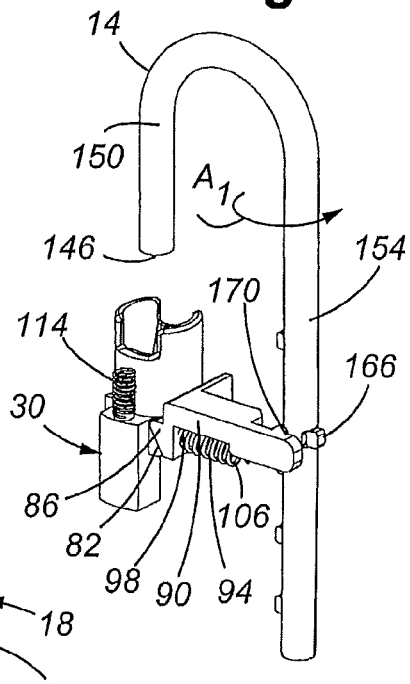
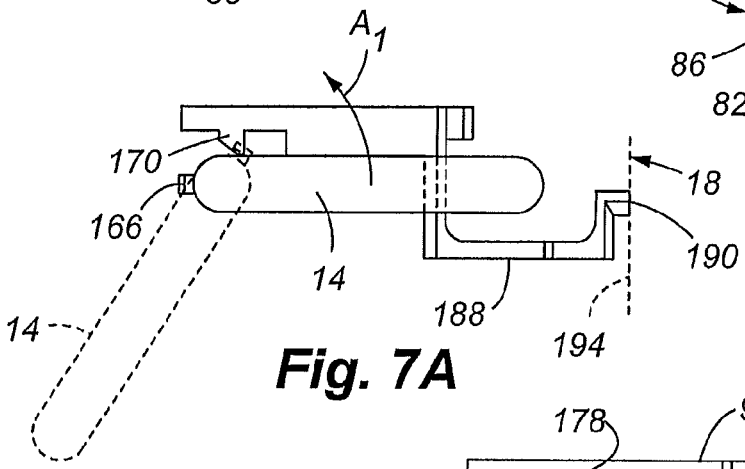
Fig. 7A
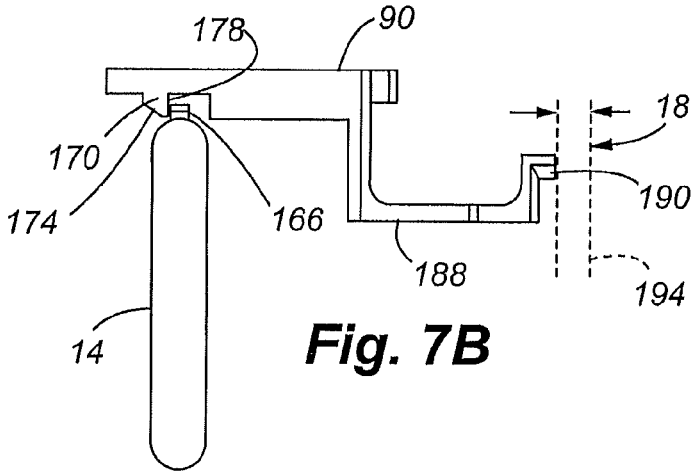
Fig. 7B

TAMPER INDICATING PADLOCK

CROSS REFERENCE TO RELATED APPLICATION

The present application is a continuation application of U.S. application Ser. No. 11/420,687 entitled "Tamper Indicating Padlock" filed May 26, 2006, which claims the benefit under 35 U.S.C. §119(e) of U.S. Provisional Patent Application Ser. No. 60/685,212 filed May 27, 2005 entitled "Tamper Indicating Padlock Design," the entire content of which are incorporated herein by reference in their entirety.

FIELD OF THE INVENTION

The invention relates generally to locking devices for items to be secured, and more particularly, to padlocks with an indicator for tampering and/or unauthorized opening and two locking units that function independently.

BACKGROUND OF THE INVENTION

The present invention relates to combination-operated padlocks of the type typically used to secure luggage during travel and transport. While traveling, luggage is out of the possession and control of the owner for long periods of time. For example, after being checked at an airline counter or at airport curbside and before being claimed at baggage claim, while in the possession of porters at a hotel, or even when sitting in a hotel room after check-in. During every one of these periods, the luggage is susceptible to unauthorized search and theft of its contents. In addition, when the Transportation Security Administration (TSA) took over the handling of airport security in accordance with the Homeland Security Act, the need arose for TSA agents to have a means of opening locked luggage without destruction of luggage padlocks used by the luggage owner to safeguard the contents. This need has resulted in the manufacture, sale and use of padlocks with dual opening mechanisms, namely, a combination mechanism for use by the luggage owner and a key mechanism for use by TSA agents with a specially designed key. Specifically, to accommodate the need of travelers for post-inspection luggage security while also accommodating the need of government employees to quickly and easily open and inspect selected and/or suspect bags, padlocks may be purchased by travelers for locking their luggage while allowing government personnel the ability to nondestructively open the locks. More particularly, if a traveler's locked bag is inspected by TSA personnel, the padlock can be opened for baggage inspection using over-ride keys that are purportedly made available only to government inspectors, and then the bag will be relocked by the inspectors to secure that bag while the bag is in transit. Unfortunately, it is now reported that TSA agents are stealing contents of luggage. It is also quite likely that the keys used by TSA agents will find their way into the possession of persons who will use the key to steal the contents of luggage.

Therefore, there is a need for a lock that provides an indicator that the key lock portion of the padlock has been tampered with, such as by advising the bag owner that an elongate object, including a key, bobbie pin or pick, has been inserted into the keyhole and/or used to attempt to open the lock. In addition, there is a need for a travel lock that provides an indicator of tampering, regardless of whether the shackle of the padlock has been unlocked, or regardless of whether the inserted elongate object, which may or may not be a key, has been turned. Furthermore, there is a need for a travel lock to provide the convenience of having the indicator reset that does not require that the shackle to be released or unlocked to reset the indicator.

SUMMARY OF THE INVENTION

These and other needs are addressed by the various embodiments and configurations of the present invention. Accordingly, the present invention provides a duel locking device that preferably comprises both a combination lock and key lock. The device has application as a luggage lock and includes an indicator that indicates whether the lock has been tampered with by the insertion of an object into the keyhole. Preferably, one or more mechanisms are provided to reset the indicator after it has been activated.

Accordingly, a padlock for securing an article is provided that has an indicator that warns the owner/user of the lock that the key way of the lock has had an item inserted into it. The item may be an authorized key used by a TSA field agent to open the lock for purposes of inspecting the content of a piece of luggage or the item may be an unauthorized object used in an attempt to open the lock without permission of the owner/user. Thus, in accordance with at least one embodiment of the invention, a padlock is provided comprising a housing and a key lock, wherein at least a portion of the key lock is located within the housing. The padlock also preferably includes a combination lock, wherein at least a portion of the combination lock is also located within the housing. In addition, the padlock includes a shackle for engaging at least a portion of the article, the shackle at least partially contained within the housing and rotatable upon unlocking at least one of the key lock and the combination lock. Furthermore, the padlock includes an indicator having at least first and second positions, and wherein the indicator moves from the first position to the second position upon insertion of an object longitudinally into the key hole or key way of the key lock. In one embodiment, the indicator extends from a non-visible position within the housing to a visible position at least partially exterior of the housing when in the second position. Accordingly, if the indicator is triggered, the owner/user of the lock is warned, at a minimum, that someone has attempted to open the lock or has successfully opened the lock. In either case, the owner/user is advised to promptly check the contents of the luggage for missing objects.

It is a further aspect of the present invention to provide a mechanism for resetting the indicator without necessarily having to unlock or rotate the shackle. Thus, in accordance with at least one embodiment of the invention, a padlock is provided comprising a housing and a key lock, wherein at least a portion of the key lock is located within the housing. In addition, the padlock includes a combination lock, wherein at least a portion of the combination lock is also located within the housing. A shackle is also provided for engaging at least a portion of the article, the shackle at least partially contained within the housing and rotatable upon unlocking at least one of the key lock and the combination lock. In addition, the padlock includes an indicator having at least first and second positions, wherein the indicator moves from the first position to the second position upon insertion of an object longitudinally into the key hole or key way of the key lock and without turning the inserted object, or releasing the shackle or opening the lock. Finally, the padlock includes a reset mechanism operably interconnected to the indicator for moving the indicator from the second position back to the first position without moving the shackle or without unlocking the lock. In accordance with at least one embodiment of the present invention, the reset mechanism comprises an aperture in the housing and a reset mechanism within the housing. In addition, in accordance with at least one embodiment of the present invention, the reset mechanism comprises an extended portion of a brake bolt that holds the indicator in its second position and releases the indicator back to its first position upon activating the reset mechanism.

It is a further aspect of the present invention to provide alternate structure for the different components of a travel padlock. Thus, in accordance with embodiments of the present invention, a travel padlock for securing an article is provided, the travel padlock comprising a means for containing defining a chamber therein, and a means for engaging an article, the means for engaging located partially within the chamber. The travel padlock further comprises first and second means for locking located within at least a portion of the chamber, wherein both the first and second means for locking are operative to lock and unlock the means for engaging, and wherein at least one of the first and second means for locking comprises a means for receiving. In addition, the travel padlock includes a means for signaling operatively associated with the means for receiving, wherein the means for signaling has a first position and a second position and is moveable between the first and second positions. The means for signaling may extend at least partially exterior of the means for containing when in the second position, and the means for signaling is moveable from the first position to the second position upon insertion of an object into the means for receiving.

It is yet a further aspect of the present invention to provide a method of making a padlock, wherein the padlock at least includes an indicator to signal that an object has been inserted into the key way or key hole of the padlock.

It is also yet another aspect of the present invention to provide a method of using a padlock, wherein the method includes signaling that an object has been inserted into the key way or key hole of the padlock. The method also may comprise providing a method of resetting the indicator from a signaling position to a non-signaling position.

These and other advantages will be apparent from the disclosure of the invention(s) contained herein. Various embodiments of the present invention are set forth in the attached figures and in the detailed description of the invention as provided herein and as embodied by the claims. It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

BRIEF DESCRIPTION OF THE DRAWINGS

Several drawings have been developed to assist with understanding the invention. Following is a brief description of the drawings that illustrate the invention and its various embodiments.

FIG. 1 is a perspective view of a first embodiment of the present invention;

FIG. 1A is a perspective view of the device of FIG. 1 with the indicator in its second position;

FIG. 5 is a side elevation view of the device shown in FIG. 1 with the combination lock unlocked and the shackle rotated;

FIG. 6 is perspective view of the shackle, the brake bolt, and the indicator;

FIGS. 7A and 7B are top plan views showing the shackle being rotated and the brake bolt moved to reset the indicator;

Figure 2:
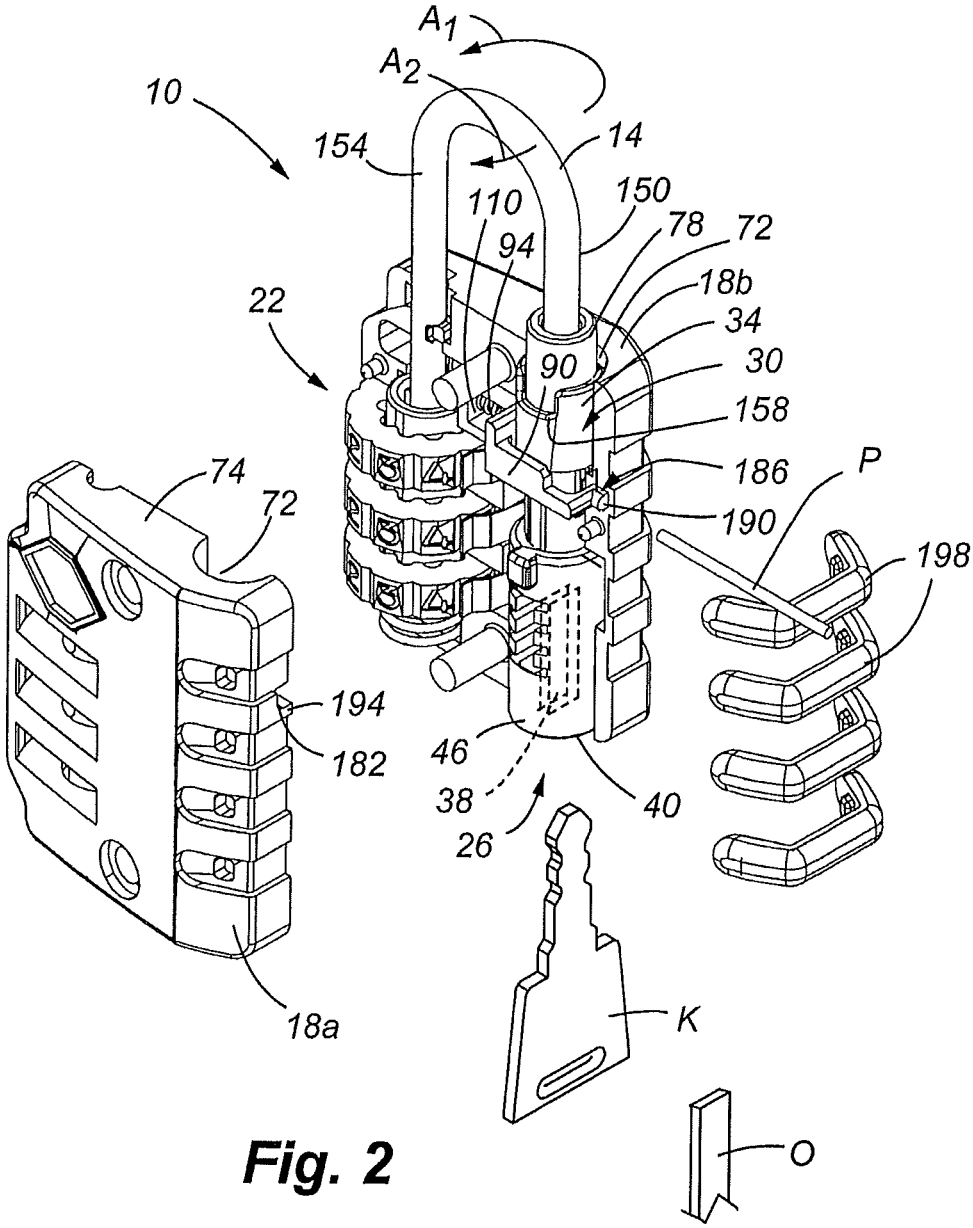
FIG. 2 is a perspective view of the device shown in FIG. 1, wherein a housing member is shown separated from the remaining portions of the device.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION

The present invention comprises a padlock that includes a means for detecting whether an object has been inserted into the key hole or key way of the padlock. For example, when traveling, luggage is often out of the possession and control of the owner. The insertion of an object into the key hole of the travel padlock, for example when someone attempts to pick the key lock, activates a warning indicator within the key lock mechanism in a manner visible to the owner or user. As a result, when the owner retrieves his or her luggage, the owner is able to observe the indicator that remains observable until such time as the owner resets the indicator.

Referring now to FIGS. 1 and 1A, and in accordance with at least one embodiment of the present invention, a travel padlock 10 is provided that includes a shackle 14 for engaging an item to be secured. The travel padlock 10 includes a body or housing 18, that may comprise a plurality of sections, such as a first housing member 18*a* and a second housing member 18*b*. The travel padlock 10 also preferably includes a plurality of locking mechanisms, such as a combination lock 22, and as can be seen in FIGS. 2 and 3, a key lock 26, wherein the two locking units 22 and 26 can both be used independently to lock and unlock the travel padlock 10.

Figure 3:
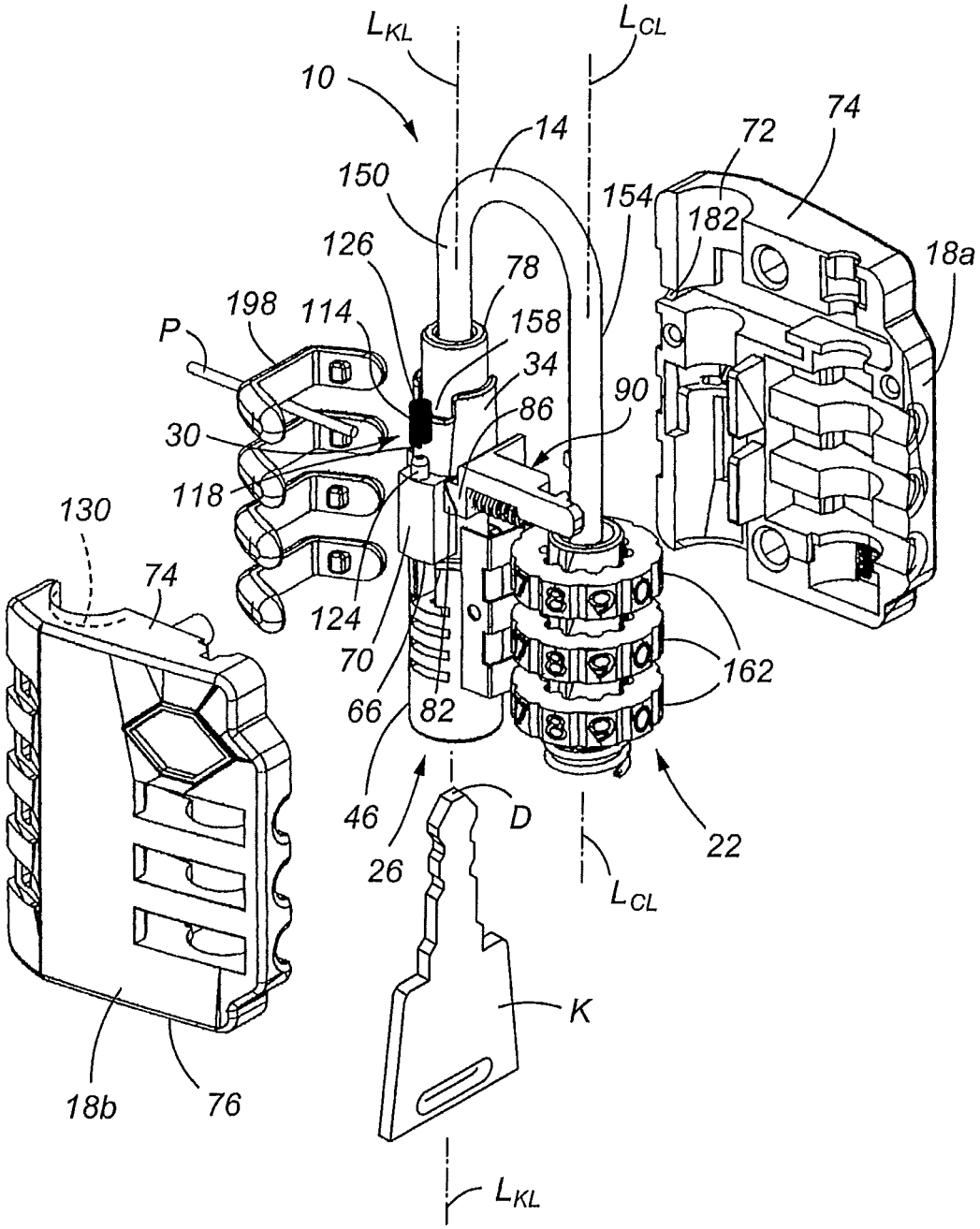
FIG. 3 is a reverse perspective view from that shown in FIG. 2, wherein both housing members are exploded from the remaining portions of the device.

Referring now to FIGS. 2 and 3, the travel padlock 10 includes an indicator 30 for indicating whether an attempt was made at opening the travel padlock 10 by inserting an object O into the key lock 26. More particularly, and as discussed in more detail below, an upper end portion 34 of the indicator 30 extends from the housing 18 when a key K or other appropriately sized object O is inserted into the key hole 38 of the key lock 26. The key K or object O do not have to be rotated to trigger the indicator 30, nor does the lock have to be open or the shackle released.

Figure 4:
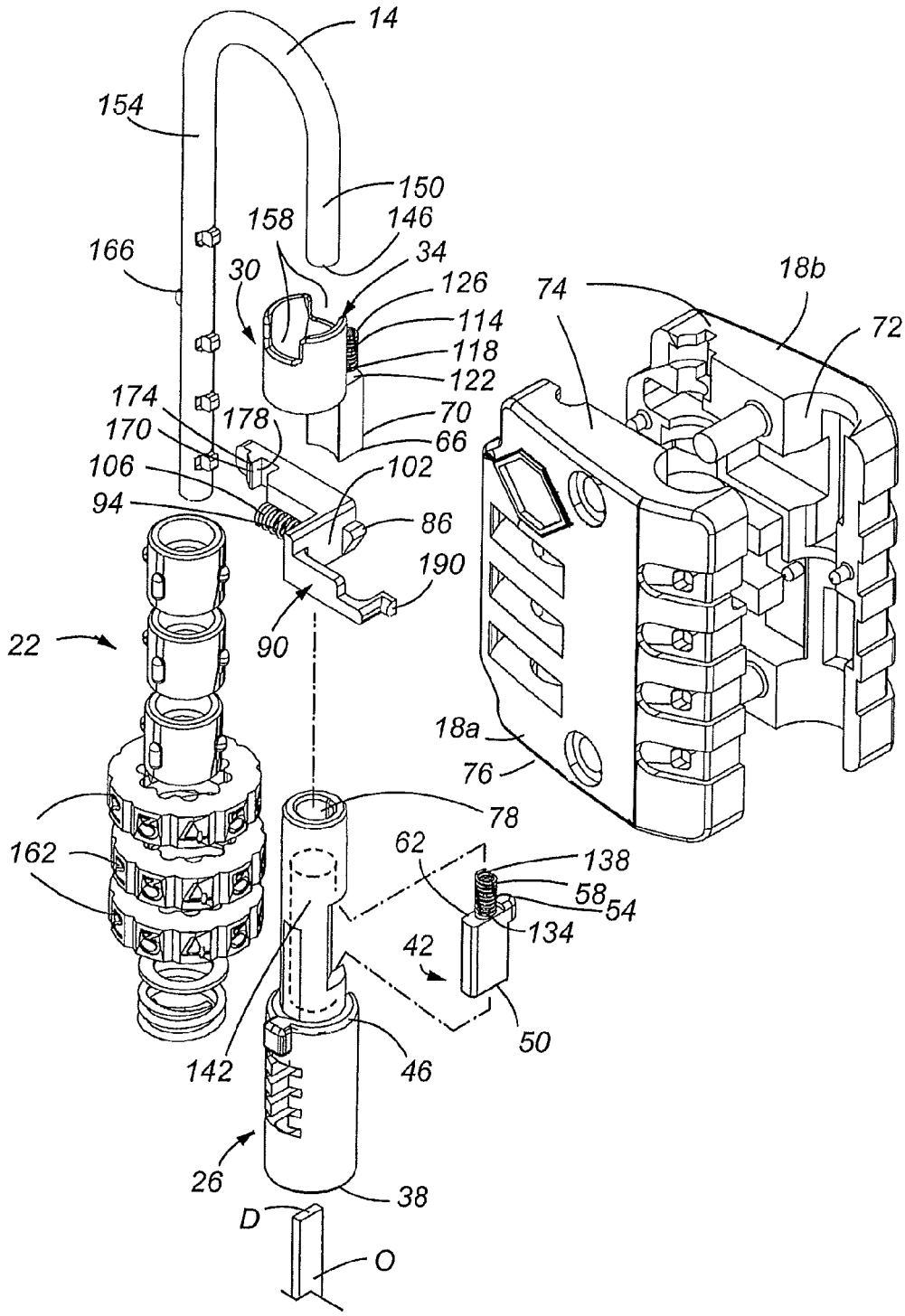
FIG. 4 in an exploded perspective view of portions of the device shown in FIG. 1.
Figure 8:
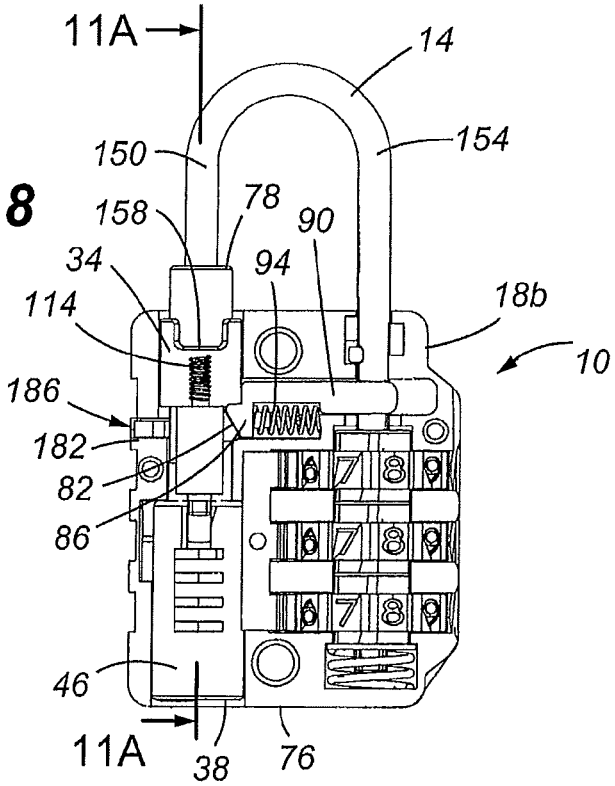
FIG. 8 is a side elevation view of the device of FIG. 1 with the indicator in the first position.

As best seen in FIG. 4, an activation member 42 resides within a cylinder 46 of the key lock 26. The activation member 42 includes a bottom surface 50, a lateral projection 54, and a biasing member, such as a compression spring 58, located on an upper portion 62 of the activation member 42. When a key K or object O is inserted into the key hole 38 of the key lock 26, the distal end D of the key K or object O impinges on the bottom surface 50 of the activation member 42. As the key K or object O is pushed longitudinally within the key way 38 of cylinder 46 of the key lock 26, the activation member 42 also moves longitudinally upward (relative to FIG. 4), and in so doing, the lateral projection 54 of the activation member 42 pushes a distal end 66 of a lateral offset 70 of the indicator 30, thereby also advancing the upper end portion 34 of the indicator 30 in an upward longitudinal direction such that at least a portion of the upper end portion 34 of the indicator 30 projects through an opening 72 in the housing 18 and above a top surface 74 of the housing 18. The upper end portion 34 of the indicator 30 preferably includes coloring, visual aspects, or other means for contrasting with the housing 18, shackle 14, and shackle cup 78 at the top of the cylinder 46.

Figure 10:
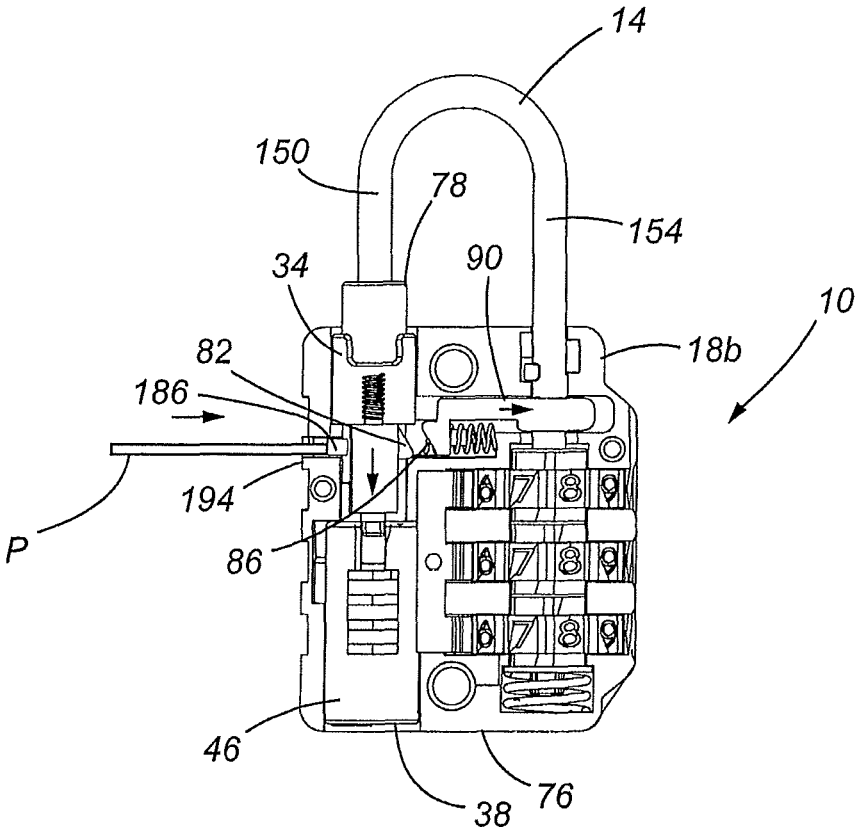
FIG. 10 is a side elevation view of the device of FIG. 1 with a pin being used to reset the indicator.

Referring again to FIGS. 3 and 4, as the indicator 30 is pushed longitudinally upward from its first or lower position to its second or upper position, a sloped projection 82 on the side of the lateral offset 70 slides past a sloped catch 86 of a transversely oriented brake bolt 90. As the sloped projection 82 of the indicator 30 moves upward, it laterally displaces the brake bolt 90 until the sloped projection 82 longitudinally passes the sloped catch 86, at which point the brake bolt 90 moves back toward the lateral offset 70 under a force exerted by a biasing member, such as compression spring 94, that was compressed as the brake bolt 90 was initially displaced laterally. The compression spring 94 preferably includes a first end 98 acting on a flange 102 of the brake bolt 90, and a second end 106 acting against an internal flange 110 of the housing member 18*b*. When the brake bolt 90 moves back to its first position, the indicator 30 is resettably secured in its second or upper position corresponding to indicating that a key K or object O has been inserted into the key way 38 of the key lock 26. In addition, as the indicator 30 is moved to its second position, a biasing member, such as compression spring 114 of the indicator 30, is compressed. The compression spring 114 preferably includes a first end 118 acting on a top surface 122 of the lateral offset 70, and a second end 126 acting against an internal flange 130 (as shown in FIG. 10) of the underside of top surface 74 of the housing member 18*b*. A means for interconnecting the biasing members to the various applicable structures of the travel padlock may be used. For example, a post 124 may be used at the bottom of compression spring 114 to position the spring 114 onto surface 122 of the lateral offset 70. Upon removing the key K or object O from the key lock 26, the activation member 42 returns to its initial position because of compression spring 58 located at the top surface 62 of the activation member 42. The compression spring 58 of the activation member 42 preferably includes a first end 134 acting on the top surface 62 of the activation member 42, and a second end 138 acting on an interior surface 142 of the cylinder 46.

The key lock 26 may be opened using a properly configured key K, such as an authorized over-ride key made available to TSA employees. The key lock 26 has a locked position and an unlocked position. The key lock 26 includes the shackle cup 78 situated at the top of the cylinder 46. When the travel padlock 10 is locked, an end 146 of a first leg or short shackle leg 150 of the shackle 14 resides within the shackle cup 78. When an authorized key K is inserted into the key way and rotated to unlock the key lock 26, the cylinder 46 is also rotated and may be moved axially or in a longitudinal downward direction (relative to FIG. 4). When the cylinder 46 is lowered to its downward unlocked position, the shackle cup 78 is also lowered, thereby allowing the shackle 14 to be rotated. More particularly, the end 146 of the short shackle leg 150 is no longer located within the shackle cup 78 but is located above the top of the lowered shackle cup 78, thereby allowing the shackle 14 to be rotated about its second leg or long shackle leg 154, and the travel padlock 10 is then able to be opened. Thus, the short shackle leg 150 is disposed opposite the long shackle leg 154. In the locked position, the end 146 of the short shackle leg 150 is disposed within the shackle cup 78 of the key lock 26 such that the shackle 14 may not be rotated about its long shackle leg 154, and therefore, the short shackle leg 150 remains longitudinally aligned with both the cylinder 46 and the indicator 30. The shackle 14 may be rotated about its long shackle leg 154 when the padlock 10 has been unlocked using a key K. That is, the short shackle leg 150 is able to be rotated out of longitudinal alignment with both the cylinder 46 and the indicator 30. When unlocked, preferably, the short shackle leg 150 may be rotated in either direction away from the shackle cup 78 because the upper end portion 34 of the indicator 30 includes oppositely positioned recesses or cut-outs 158. Alternatively, a single recess 158 may be provided for allowing the shackle 14 to rotate in only one direction. Whether one or two recesses 158 are used, the recesses 158 also provide a texture or tactile uniqueness that allow a visually impaired user to feel the upper end portion 34 of the indicator 30 in its upward position using their finger tips. That is, preferably the upper end position 34 of the indicator 30 includes not only a visual indicator, but also a tactile feature perceptible to a person's touch.

Referring now to FIGS. 3 and 4, the combination lock 22 may also be used to lock and unlock the travel padlock 10. In accordance with at least one embodiment of the present invention, the combination lock 22 includes one or more dial wheels 162 that are used to provide the combination to the combination lock 22. When the combination lock 22 is locked, the shackle 14 is prevented from longitudinal or axial movement. When the combination lock 22 is unlocked, the shackle 14 is allowed to move axially in an upward longitudinal direction relative to the top surface 74 of the housing 18. This axial motion of the shackle 14 allows the end 146 of the short shackle leg 150 to clear the top of the shackle cup 78 of cylinder 46 when cylinder 46 and shackle cup 78 of the key lock 26 are in their upper position above the top surface 74 of the housing 18.

Referring now to FIGS. 4-7B, and in accordance with at least one embodiment of the present invention, the combination lock 22 also provides a first means for resetting the indicator 30 from its second or upper position back to its first or lower position. More particularly, as noted above, upon unlocking the combination lock 22, the shackle 14 can be moved axially to disengage the end 146 of the short shackle leg 150 of the shackle 14 from the shackle cup 78. The upper longitudinal position of the shackle 14 also places a reset lug 166 that is located on the long shackle leg 154 of the shackle 14 into alignment with a reset projection 170 located on the brake bolt 90. More particularly, the reset projection 170 of the brake bolt 90 is situated proximate the long shackle leg 154 of the shackle 14 such that when the shackle 14 is in its upper longitudinal position, the reset lug 166 can be rotated to contact the reset projection 170 of the brake bolt 90. As best seen in FIG. 4, the reset projection 170 includes a sloped surface 174 and a reset surface 178. When the shackle 14 is rotated sufficiently in the direction of arrow $A_1$ shown in FIGS. 2, 6, and 7A, the reset lug 166 impinges on the reset surface 178, thereby causing the brake bolt 90 to be pushed substantially perpendicular to, and laterally in a direction away from, a longitudinal axis $L_{k1}$-$L_{k1}$ of the key lock 26, and toward a longitudinal axis $L_{c1}$-$L_{c1}$ of the combination lock 22. This action moves the sloped catch 86 of the brake bolt 90 away from sloped projection 82 of the indicator 30. After the sloped catch 86 clears the sloped projection 82, the indicator 30 is thrust longitudinally downward from its upper or second position to its lower or first position because of compression spring 114 that was previously compressed when the indicator 30 was moved upward by insertion of the key K or object O into the key lock 26. In addition, the brake bolt 90 returns to its first position after shackle 14 resets the indicator 30 because of compression energy stored in compression spring 94 that was compressed as the shackle 14 was rotated when the reset lug 166 moved the brake bolt 90 by contacting the reset projection 170.

In accordance with at least one embodiment of the present invention, the sloped surface 174 of the reset projection 170 improves the product life and performance of the travel padlock 10, because if the shackle 14 is mistakenly rotated in a direction opposite direction arrow $A_1$, that is, in direction $A_2$, the reset lug 166 simply slips off of the reset projection 170 without forcing the break bolt 90 toward the longitudinal axis $L_{k1}$-$L_{k1}$ of the key lock 26.

Referring now to FIGS. 7A, 7B and 8-10, and in accordance with at least one embodiment of the present invention, a second means for resetting the indicator 30 is provided, wherein this second means for resetting the indicator 30 can be performed without opening the lock or rotating the shackle. The housing 18 may further comprise an aperture 182 leading to a reset mechanism 186 of the brake bolt 90. In at least one embodiment of the present invention, the reset mechanism 186 comprises a lateral extension 188 of the brake bolt 90, wherein the reset mechanism 186 has an exterior surface 190 that is preferably coplanar with or recessed relative to an outer surface 194 of the housing 18 adjacent the aperture 182. The reset mechanism 186 allows an item, such as a pin P, to be inserted into the aperture 182 to contact the exterior surface 190 of the reset mechanism 186 and laterally push the brake bolt 90 in a direction oriented substantially perpendicularly to the longitudinal axis $L_{k1}$-$L_{k1}$ of the key lock 26 toward the longitudinal axis $L_{c1}$-$L_{c1}$ of the combination lock 22. The inclusion of optional bumpers 198 (FIG. 2) assist in protecting the reset mechanism 186 from being inadvertently depressed. As per the description provided above for resetting the indicator 30 by rotating the shackle 14 after unlocking the combination lock 22, with sufficient lateral movement of the brake bolt 90 by pushing in the exterior surface 190 of the reset mechanism 186, the indicator 30 can be reset from its upper or second position to its lower or first position. Thus, the indicator 30 can be reset either by opening the combination lock 22 and sufficiently rotating the shackle 14 in the direction $A_1$, or by depressing the reset mechanism 186 within aperture 182.

Figure 11A:
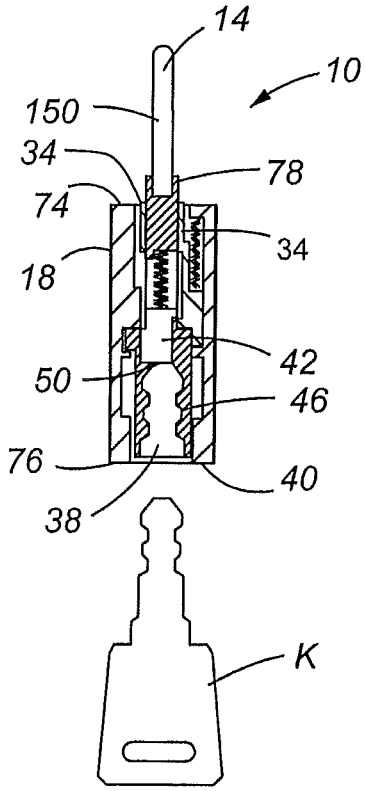
FIG. 11A is a cross-sectional view taken along line 11A-11A of FIG. 8 and illustrating the shackle in a locked position and with the indicator in its first or recessed position.
Figure 11B:
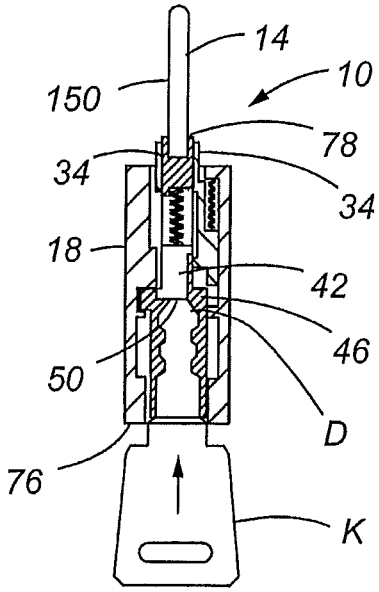
FIG. 11B is a cross-sectional view of the device shown in FIG. 11A with a key inserted into the key hole of the key lock and the indicator in its second or raised position.

Referring now to above-described figures as well as FIGS. 11A-11D, the padlock 10 provides a simple way for the owner of the lock to monitor whether someone has attempted to access their luggage. Accordingly, in use, the owner loops the shackle 14 of the lock 10 through an article to be secured, such as two opposing zipper pulls of a piece of luggage. After axially aligning the short shackle leg 150 with the shackle cup 78 and longitudinally moving the end 146 of the short shackle leg into the shackle cup 78, the dial wheels 162 of the combination lock 22 are then rotated to lock the padlock 10. As shown in FIG. 11A, at this time, the indicator 30 is recessed within the housing 18 and is not visible, the shackle cup 78 of the key lock 26 protrudes from the top surface 74 of the housing 18, and an end 146 the short shackle leg 150 is disposed within and laterally retrained by the shackle cup 78. As shown in FIG. 11B, if a TSA inspector uses an over-ride key K to unlock the padlock 10, the distal end D of the key K impinges on the bottom surface 50 of the activation member 42. That is, the key K is axially directed into the key hole 38 and engages activation member 42 that is located within cylinder 46. As described above, the activation member 42 is longitudinally movable within the cylinder 46 and is engageable with the lateral offset 70 of the indicator 30. Continued longitudinal movement of the key K within the cylinder 46 advances activation member 42, and with sufficient movement, the brake bolt 90 is moved laterally and the indicator 30 is triggered. When the indicator 30 is triggered, its upper end portion 34 extends beyond the top surface 74 of the housing 18 such that the upper end portion 34 is exposed and visible, and is disposed about the shackle cup 78. Thus, with insertion and advancement of a key K within the cylinder 46, the indicator 30 moves upward such that the upper end portion 34 of the indicator is visible. The triggering of the indicator occurs before the key is turned or the lock is opened.

Figure 11C:
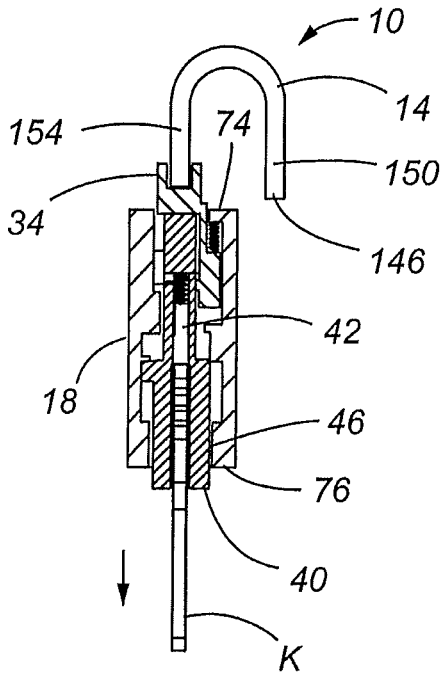
FIG. 11C is a cross-sectional view of the devise shown in FIG. 11B with the key rotated within the key hole of the key lock, the shackle rotated into its open position, and the key cylinder lowered relative to the housing.

As shown in FIG. 11C, to open the lock using a key K, the key must be turned relative to housing 18. With the key K in its turned position, the key is pulled or moved longitudinally downward. This action axially retracts the cylinder 46 within the housing 18 such that a lower end 40 of the cylinder 46 extends beyond a bottom surface 76 of the housing 18. Accordingly, when the cylinder 46 retracts, the shackle cup 78 also moves longitudinally downward relative to the top surface 74 of the housing 18 such that a top of the shackle cup 78 is substantially coplanar or below the top surface 74 of the housing 18. With the cylinder 46 and the shackle cup 78 in their retracted positions, the short shackle leg 150 is able to rotate out of axial alignment with the cylinder 46, and therefore, end 146 of the short shackle leg 150 can pass through recess 158 (not shown in FIGS. 11A-11D because of view) in the upper end portion 34 of the indicator 30 to rotate clear of the exposed portion of the indicator 30.

Figure 11D:
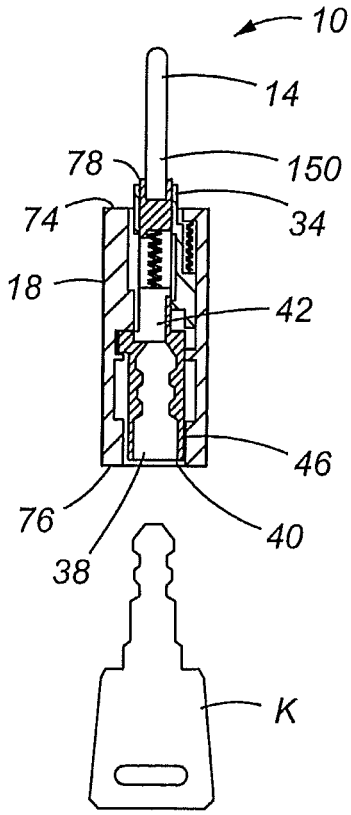
FIG. 11D is a cross-sectional view of the device shown in FIG. 11C with the key cylinder raised relative to the housing, the key removed and the indicator remaining in its second or raised position.

Referring now to FIG. 11D, after the TSA inspector is finished, the TSA inspector relocks the padlock 10 by realigning the short shackle leg 150 with the cylinder 46 and longitudinally moving the key K and cylinder 46 upward, then turning the key so that the key can then be withdrawn from the cylinder 46. After withdrawing the key K from the cylinder 46, the upper end portion 34 of the indicator 30 remains visible until such time as the indicator 30 is reset. Of course, if a key is not used but instead another appropriately-sized object O is inserted sufficiently into the cylinder 46, the object O will engage the activation member 42, thereby triggering the indicator 30.

Figure 9:
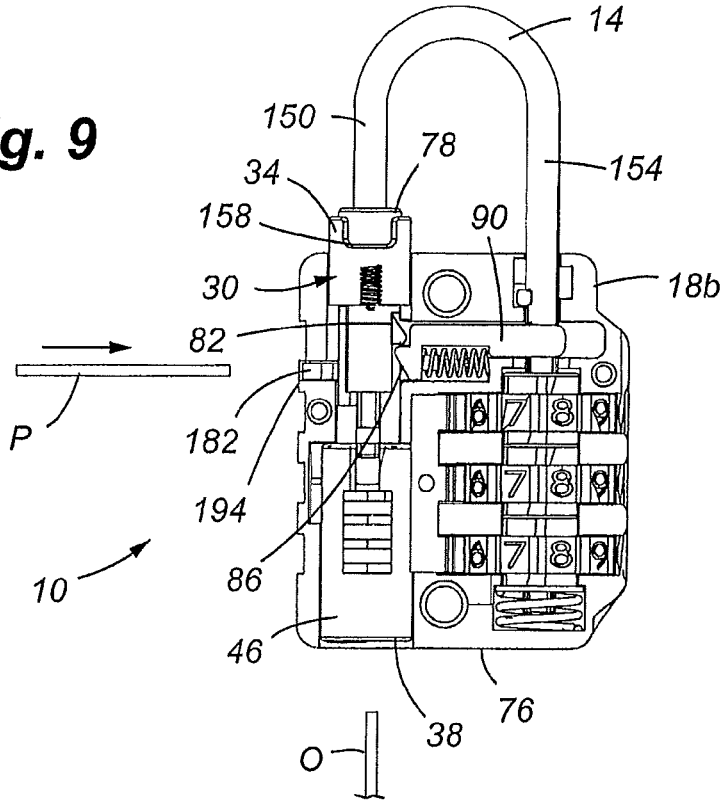
FIG. 9 is a side elevation view of the device of FIG. 1A with the indicator in the second position.

The owner can reset the indicator 30 by unlocking the padlock 10 using the combination lock 22. In resetting the indicator 30 using the combination lock 22, the owner first rotates the dials wheels 162 to their proper combination and then longitudinally pulls the shackle 14 upward in a direction away from the top surface 74 of the housing 18. By doing so, the end 146 of the short shackle leg 150 clears the shackle cup 78 so that the short shackle leg 150 can rotate out of alignment with the cylinder 46. By sufficiently rotating the extended shackle 14 in the direction of arrow $A_1$ about the long shackle leg 154 as shown in FIGS. 6 and 7A, the reset lug 166 of rotating shackle 14 laterally pushes the brake bolt 90 so that the indicator 30 longitudinally retracts within the housing 18. As shown in FIGS. 9 and 10, as an alternative to using the combination lock 22 and rotating the long shackle leg 154, the owner can insert a pin P in aperture 182 to directly push the brake bolt 90 in a direction transverse to the longitudinal axis $L_{k1}$-$L_{k1}$ of the key lock 26, or transverse to a leg 150, 154 of the shackle 14, such that the indicator 30 disengages from the brake bolt 90, wherein the upper end portion 34 of the indicator 30 retracts into the housing 18.

In accordance with at least one embodiment of the present invention, a method of making a padlock is also provided. The method comprises providing a housing with a movable shackle in association with the housing, and positioning a key lock and a combination lock in the housing, wherein the combination lock and key lock are independently operable to lock and unlock the shackle. The method also includes positioning an indicator in the housing, wherein the indicator is movable from a first position to a second position upon an object being longitudinally inserted into the key lock. The method of making may also include providing a reset mechanism for resetting the indicator from the second position to the first position, wherein an aperture in the housing leads to the reset mechanism. In accordance with at least one embodiment of the invention, the indicator is tactilely discernible when in the second position.

In accordance with another aspect of the invention, a method of using a padlock having a indicator or signaling feature is provided. Thus, in at least one embodiment of the invention, a method is provided for using a padlock to secure an article, the method comprising passing a shackle of the padlock through at least a portion of the article, the shackle including a first leg operatively associated with a combination lock, the shackle further including a second leg operatively associated with a key lock, wherein the combination lock and the key lock are at least partially contained within a housing. The method also includes locking the shackle in a locked position, and signaling that an object has been inserted into a key way of the key lock. In at least one embodiment of the present invention, the signaling comprises an indicator, wherein at least a portion of the indicator extends beyond a surface of the housing, and wherein the indicator may be visually seen by an observer of the padlock. In at least one embodiment, the object inserted into the key way or key hole may comprise an authorized over-ride key. In at least one embodiment, the signaling does not require rotation of the object. In addition, in at least one embodiment, the indicator is tactilely discerning when extended beyond the surface of the housing. In at least one embodiment of the invention, the method of using the padlock also comprises resetting the indicator from extending beyond the surface of the housing to substantially residing within the housing by setting a combination to the combination lock, releasing the shackle from its locked position, and rotating the shackle about its first leg. In yet at least one other embodiment of the invention, the method of using comprises resetting the indicator from extending beyond the surface of the housing to substantially residing within the housing, wherein the resetting is performed without opening the combination lock. In at least one embodiment, the resetting does not require one or more of (a) unlocking the shackle, and (b) rotating the shackle. In addition, in at least one embodiment, the resetting comprises accessing a reset mechanism for the indicator through an aperture in the housing. In addition, the resetting may comprise advancing the reset mechanism in a direction transverse to a surface comprising the aperture.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A padlock for securing an article, the padlock comprising:

a housing;

at least one of a key lock and a combination lock, wherein when a key lock is present, at least a portion of said key lock is located within said housing and said key lock comprises a key way;

a shackle for engaging at least a portion of the article, said shackle at least partially contained within said housing and rotatable upon unlocking at least one of the key lock and the combination lock;

an indicator having at least first and second positions, said indicator projecting at least partially exterior of said housing when in said second position; and wherein, when the indicator is in the second position and the shackle is locked, the indicator extends along at least a portion of the shackle.

2. The padlock as claimed in claim 1, wherein when at least a key lock is present said indicator moves from said first position to said second position upon insertion of an object longitudinally into said key way and without rotation of the object.

3. The padlock as claimed in claim 2, wherein the object comprises a key or an elongated member.

4. The padlock as claimed in claim 2, wherein said object does not have to be turned within said key way for said indicator to move from said first position to said second position.

5. The padlock as claimed in claim 1, wherein when a key lock and a combination lock are present, at least a portion of the key lock and the combination lock are located within the housing and said indicator moves from said first position to said second position upon insertion of an object longitudinally into said key way without opening either of the combination lock or the key lock.

6. The padlock as claimed in claim 1, wherein when at least a key lock is present the indicator is resettable from said second position to said first position by activating a reset mechanism not requiring rotation of the shackle.

7. The padlock as claimed in claim 6, wherein the reset mechanism comprises a reset device accessible through an aperture in said housing.

8. The padlock as claimed in claim 6, wherein the shackle has a leg portion and said reset mechanism is moveable in a direction transverse to the leg portion of said shackle.

9. The padlock as claimed in claim 6, wherein the reset mechanism can be activated while said shackle is locked.

10. The padlock as claimed in claim 1, wherein when at least a key lock is present an activation mechanism is operatively associated with said indicator, and wherein said indicator is moved from said first position to said second position by contacting said activation mechanism with an object inserted into said key way and without rotation of the object.

11. The padlock as claimed in claim 10, wherein said activation mechanism is movable in a direction substantially parallel to a leg portion of said shackle.

12. The padlock as claimed in claim 1, wherein the indicator is tactilely discernible in its second position.

13. The padlock as claimed in claim 12, wherein the second position of the indicator is visually discernible.

14. The method as claimed in claim 1, wherein when a key lock and combination lock are present, a portion of the combination lock is positioned within said housing and the combination lock and key lock are independently operable to lock and unlock the shackle.

15. A method of making a lock, comprising:

a. providing a housing;

b. providing a movable shackle in association with said housing;

c. positioning at least a key lock in said housing; the key lock operable to lock and unlock the shackle; and d. positioning an indicator in the housing, the indicator movable from a first position to a second position upon an object being longitudinally inserted into the key lock and without rotation of the object.

16. The method claimed in claim 15, further comprising providing a reset mechanism for resetting the indicator from the second position to the first position.

17. The method as claimed in claim 15, further comprising providing a reset mechanism within said housing wherein said reset mechanism resets said indicator without movement of said shackle.

18. The method as claimed in claim 15, further comprising providing a reset mechanism within said housing wherein said reset mechanism resets said indicator without insertion of an object into the key lock.

19. The method as claimed in claim 15, further comprising positioning a combination lock in said housing, wherein the combination lock and key lock are independently operable to lock and unlock the shackle.

20. A lock for securing an article, the lock comprising:

a housing;

a key lock, wherein at least a portion of said key lock is located within said housing and said key lock comprises a key way;

a shackle for engaging at least a portion of the article, said shackle at least partially contained within said housing and rotatable upon unlocking of the key lock;

an indicator having at least first and second positions, wherein said indicator moves from said first position to said second position upon insertion of an object longitudinally into said key way and without rotation of the object; and a reset mechanism operably interconnected to said indicator for moving said indicator from said second position back to said first position without moving said shackle and without use of a key.

21. The lock of claim 20, further comprising a combination lock, wherein at least a portion of said combination lock is located within said housing.

22. The lock as claimed in claim 20, wherein the reset mechanism comprises an aperture in said housing and a reset member within said aperture.

23. The lock as claimed in claim 21, wherein the indicator is resettable from said second position to said first position by unlocking said combination lock and rotating said shackle.

24. The lock as claimed in claim 20, wherein said indicator is tactilely discernible in said second position.

25. In a lock having at least a key portion having a key way to receive a key to open the lock, a method of determining if the key portion has been tampered with, comprising:

a. locking the lock;

b. causing an indicator to change from a first state to a second state by inserting an object into the key way portion of the key portion of the lock and without other movement of the object in the key way.

* * * * *